United States Patent [19]

Inoue et al.

[11] Patent Number: 4,529,526

[45] Date of Patent: Jul. 16, 1985

[54] LUBRICATING OIL COMPOSITION

[75] Inventors: Kazuo Inoue, Tokyo; Akio Imahashi, Ichihara, both of Japan

[73] Assignees: Honda Motor Co., Ltd.; Idemitsu Kosan Co., Ltd., both of Tokyo, Japan

[21] Appl. No.: 551,324

[22] Filed: Nov. 14, 1983

[30] Foreign Application Priority Data

Nov. 30, 1982 [JP] Japan ..... 57-210455

[51] Int. Cl.[3] ..... C10M 1/48

[52] U.S. Cl. ..... 252/32.7 E

[58] Field of Search ..... 252/32.7 E

[56] References Cited

U.S. PATENT DOCUMENTS

| | | | |
|---|---|---|---|
| 3,254,025 | 5/1966 | Le Suer | 252/32.7 E |
| 3,402,188 | 9/1968 | Wiese | 252/32.7 E |
| 3,446,735 | 5/1969 | Wiese | 252/32.7 E |
| 3,840,463 | 10/1974 | Froeschman et al. | 252/32.7 E |
| 3,925,213 | 12/1975 | Froeschman et al. | 252/32.7 E |
| 4,098,705 | 7/1978 | Sakurai et al. | 252/33.6 |
| 4,375,418 | 3/1983 | Zoleski et al. | 252/32.7 E |

OTHER PUBLICATIONS

Smalheer et al., *Lubricant Additives,* 1967; Chap. 1.

*Primary Examiner*—William R. Dixon, Jr.
*Assistant Examiner*—C. Johnson
*Attorney, Agent, or Firm*—Frishauf, Holtz, Goodman & Woodward

[57] ABSTRACT

A lubricating oil composition comprising:

(1) 98.6 to 53% by weight of a base oil having a kinematic viscosity of 3 to 20 centistokes as determined at 100° C.;

(2) 0.2 to 5% by weight of a sulfurized oxymetal organophosphorodithioate represented by the formula (I):

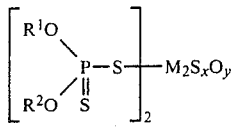

(I)

and/or sulfurized oxymetal dithiocarbamate represented by the formula (II):

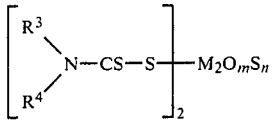

(II)

(3) 0.1 to 7% by weight of at least one zinc dithiophosphate represented by the formula (III):

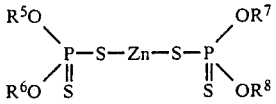

(III)

(4) 0.1 to 20% by weight of a calcium alkylbenzenesulfonate and/or a calcium petroleumsulfonate; and (5) 1 to 15% by weight of alkenylsuccinic acid imide and/or boron derivatives thereof. The present lubricating oil composition is superior in reducing the mechanical friction loss of four-cycle engines, particularly small-sized high power four-cycle engines when used as an engine oil.

21 Claims, No Drawings

LUBRICATING OIL COMPOSITION

FIELD OF THE INVENTION

The present invention relates to a lubricating oil composition, and more particularly, to a lubricating oil composition superior in reducing the mechanical friction loss of, in particular, small-sized, high power four-cycle engines.

BACKGROUND OF THE INVENTION

As is well known, one of the methods of increasing the power of an engine is to increase the engine speed or the number of revolutions of the engine. Several engines for two-wheeled vehicles, which are required to be of small size and to have high power, are known to have a practical maximum engine speed of more than 10,000 revolutions per minute. Since thermal efficiency is reduced when the engine speed is increased, it is necessary to control the reduction of thermal efficiency. For this purpose, it has heretofore been attempted to increase the number of intake and exhaust valves per cylinder. Four valve engines having two valves for intake and two valves for exhaust per cylinder are presently in practical use.

However, as the number of valves of a cylinder is increased, the opening and closing mechanism of the valve becomes more complicated. This gives rise to an undesirable increase in mechanical friction loss. This increase in mechanical friction loss will lead to a reduction in shaft horsepower, which is particularly noticeable at low load running, such as idle running.

SUMMARY OF THE INVENTION

An object of the invention is to provide a lubricating oil composition which is superior in reducing the mechanical friction loss of small-sized, high power four-cycle engines as described above.

The present invention relates to a lubricating oil composition comprising:

(1) 98.6 to 53% by weight of a base oil having a kinematic viscosity of 3 to 20 centistokes (cSt) as determined at 100° C.;

(2) 0.2 to 5% by weight of a sulfurized oxymetal organophosphorodithioate represented by general formula (I) as described hereinafter and/or a sulfurized oxymetal dithiocarbamate represented by general formula (II) as described hereinafter;

(3) 0.1 to 7% by weight of at least one zinc dithiophosphate represented by general formula (III) as described hereinafter;

(4) 0.1 to 20% by weight of a calcium alkylbenzenesulfonate and/or a calcium petroleumsulfonate; and (5) 1 to 15% by weight of an alkenylsuccinic acid imide and/or a boron derivative thereof.

DETAILED DESCRIPTION OF THE INVENTION

The major component of the composition of the present invention, Component (1), is a base oil which is used in an amount of 53 to 98.6% by weight, preferably 70 to 97% by weight, based on the total weight of the composition. This lubricating base oil is required to have a kinematic viscosity of from 3 to 20 centistokes, preferably from 6 to 12 centistokes, as determined at 100° C. If the kinematic viscosity at 100° C. is lower than 3 centistokes, seizure occurs, increasing the consumption of oil. If the kinematic viscosity at 100° C. is above 20 centistokes, the amount of fuel consumed increases, and the formation of carbon deposit increases, making the lubricating oil composition unsuitable for practical use.

Suitable examples of such mineral oils include 60 Neutral Oil, 100 Neutral Oil, 150 Neutral Oil, 300 Neutral Oil, 500 Neutral Oil, and Bright Stock, which are all obtained by solvent refining or hydrogenation refining.

Suitable examples of synthetic oils include polyolefins, polyglycol esters, polyol esters, phosphates, silicone oil, alkyldiphenyls, and dibasic acid esters.

The mineral oils and the synthetic oils constituting Component (1) can be used alone or in combination with each other. In the latter case, an oil which has the kinematic viscosity outside the above range can be used, provided that the combination oils has the kinematic viscosity within the above range.

The sulfurized oxymetal organophosphorodithioate as used herein as Component (2) is represented by general formula (I):

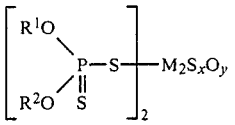

(I)

wherein M is molybdenum or tungsten, $R^1$ and $R^2$ may be the same or different, each of $R^1$ and $R^2$ contains from 1 to 30 carbon atoms and are an alkyl group, a cycloalkyl group, an aryl group or an alkylaryl group, and x and y are positive real numbers satisfying the equation $x+y=4$.

The sulfurized oxymetal organophosphorodithioates can be prepared by, e.g., the method described in Japanese Patent Publication No. 27366/1969, i.e. U.S. Pat. No. 3,400,140. Typical examples are sulfurized oxymolybdenum diisopropylphosphorodithioate, sulfurized oxytungsten diisopropylphosphorodithioate, sulfurized oxymolybdenum diisobutylphosphorodithioate, sulfurized oxymolybdenum di(2-ethylhexyl)phosphorodithioate, sulfurized oxymolybdenum diphenylphosphorodithioate, sulfurized oxymolybdenum di(p-tert-butylphenyl)phosphorodithioate, sulfurized oxytungsten di(p-tert-butylphenyl)phosphorodithioate, sulfurized oxymolybdenum di(nonylphenyl)phosphorodithioate and sulfurized oxymolybdenum dicyclohexyl phosphorodithioate. These compounds can be used singly or in combination with each other.

In combination with or in place of the sulfurized oxymetal organophosphorodithioate as described above, a sulfurized oxymetal dithiocarbamate represented by general formula (II):

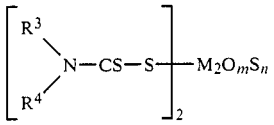

(II)

wherein M is molybdenum or tungsten, $R^3$ and $R^4$ may be the same or different, each of $R^3$ and $R^4$ contains from 1 to 30 carbon atoms and are an alkyl group, a cycloalkyl group, an aryl group or an alkylaryl group, and m and n are positive real numbers satisfying the equation: $m+n=4$, can be used as Component (2) of the invention.

The sulfurized oxymetal dithiocarbamates can be prepared by, e.g., the method described in Japanese Patent Publication No. 6362/1974. Typical examples are sulfurized oxymolybdenum dibutyldithiocarbamate, sulfurized oxytungsten dibutyldithiocarbamate, sulfurized oxymolybdenum diethyldithiocarbamate, sulfurized oxytungsten di(2-ethylhexyl)dithiocarbamate, sulfurized oxymolybdenum diamyldithiocarbamate, sulfurized oxymolybdenum dilauryldithiocarbamate, sulfurized oxymolybdenum di(oleyllinoleyl)dithiocarbamate, sulfurized oxymolybdenum di(p-tert-butylphenyl)dithiocarbamate, and sulfurized oxymolybdenum dicyclohexyldithiocarbamate. These compounds can be used singly or in combination with each other.

The sulfurized oxymetal organophosphorodithioates of general formula (I) and the sulfurized oxymetal dithiocarbamates of general formula (II) as used herein as Component (2) act as extreme pressure agents. Component (2) is required to constitute from 0.2 to 5% by weight of the total composition. If Component (2) is added in an amount of less than 0.2% by weight, the effect of Component (2) is not sufficiently obtained. On the other hand, even if the amount of Component (2) is increased to more than 5% by weight, the mechanical friction loss-reducing effect is not significantly increased and undesirable corrosion results. The preferred amount of Component (2) is between 0.3 and 3% by weight.

Component (3) of the composition of the invention is at least one zinc dithiophosphate represented by general formula (III):

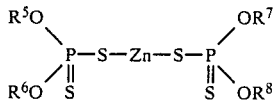

(III)

wherein $R^5$ to $R^8$ may be the same or different and are each a primary alkyl group containing from 1 to 20 carbon atoms preferably from 3 to 12 carbon atoms, a secondary alkyl group containing from 3 to 20 carbon atoms, preferably from 3 to 12 carbon atoms, an aryl group or an aryl group substituted by an alkyl group, said alkyl substituent containing from 1 to 20 carbon atoms preferably from 3 to 18 carbon atoms.

There are various zinc dithiophosphate compounds in which $R^5$ to $R^8$ are all the same or are different from each other. They are used herein alone or as a mixture comprising two or more thereof. In addition, zinc dithiophosphate compounds in which $R^5$ to $R^8$ are all different from each other can be used alone or in admixture with zinc dithiophosphate compounds in which $R^5$ to $R^8$ are all the same. The proportion of the secondary alkyl groups containing from 3 to 20 carbon atoms relative to the total amount of $R^5$ to $R^8$ in all zinc dithiophosphate compounds employed as Component (3) must be at least 50% by weight, preferably in the range of 60 to 100% by weight.

Various zinc dithiophosphates used in the present invention are commercially available. Examples include Lubrizol 677 (in which most of $R^5$ to $R^8$ are secondary hexyl groups), Lubrizol 1060 (in which most of $R^5$ to $R^8$ are secondary alkyl groups containing 5 or less carbon atoms), Lubrizol 1360 (in which $R^5$ to $R^8$ are isobutyl and n-amyl groups), and Lubrizol 1370 (in which most of $R^5$ to $R^8$ are alkylaryl groups), all being sold by Lubrizol Japan, Ltd., Oloa 260 (in which most of $R^5$ to $R^8$ are alkylaryl groups) and Oloa 267 (in which most of $R^5$ to $R^8$ are isoamyl groups), both being sold by Chevron Chemical Company (U.S.A.), Santoluble 393 (in which most of $R^5$ to $R^8$ are secondary hexyl groups) sold by Monsanto Co. (U.S.A.), and Amoco 198 (in which most of $R^5$ to $R^8$ are isobutyl and n-amyl groups) sold by Amoco Chemicals Co. (U.S.A.). These compounds can be used alone or in combination with each other so that the proportion of the secondary alkyl groups in $R^5$ to $R^8$ to the total amount $R^5$ to $R^8$ is at least 50% by weight. Preferably, secondary alkyl groups in $R^5$ to $R^8$ are the same, and these compounds are used in combination with each other.

The zinc dithiophosphates of general formula (III) have many functions in the present invention. They serve as an extreme pressure agent (which improves load carrying capacity and wear resistance), an antioxidant, a corrosion inhibitor, and the like. The amount of Component (3) in the lubricating oil composition should be from 0.1 to 7% by weight based on the total weight of the composition, with the range of from 0.3 to 3% by weight being preferred. If the amount of Component (3) is less than 0.1% by weight, the beneficial effects previously described are not sufficiently obtained. On the other hand, even if Component (3) is used in an amount exceeding 7% by weight, the beneficial effects described previously are not significantly increased or may actually be reduced.

Component (4) of the composition of the present invention is a calcium alkylbenzenesulfonate and/or a calcium petroleumsulfonate—wherein the alkyl group has from 1 to 50 carbon atoms. Examples of such calcium alkylbenzenesulfonates include calcium dodecylbenzenesulfonate, calcium didodecylbenzenesulfonate, calcium hexadecylbenzenesulfonate, calcium eicosylbenzenesulfonate, calcium dieicosylbenzenesulfonate, and calcium tetracosylbenzenesulfonate.

Calcium alkylbenzenesulfonates and/or a calcium petroleumsulfonate, as described above, act as a cleaner detergent. The amount of Component (4) should be from 0.1 to 20% by weight based on the total weight of the composition. Preferably the amount of Component (4) is from 0.2 to 10% by weight. If the amount of Component (4) is less than 0.1% by weight, the beneficial effect described previously is not sufficiently obtained. On the other hand, even if Component (4) is added in an amount greater than 20% by weight, the beneficial effect is not increased.

It is necessary for the composition of the invention to further contain Component (5), alkenylsuccinic acid imides or boron derivatives thereof. The alkenyl group contains from 30 to 300 carbon atoms. A number of alkenylsuccinic acid imides are commercially available, including OLOA-1200N and OLOA-373 manufactured by Chevron Chemical Company, LUBRIZOL 6406 as manufactured by The Lubrizol Corporation, and HITEC 628 as manufactured by Edwin Copper, Inc.

Boron derivatives of such alkenylsuccinic acid imides include:

Compounds prepared by reacting alkyleneamines with boron containing compounds and then reacting the reaction products thus obtained with alkyl-substituted succinic anhydrides (see Japanese Patent Publication No. 8013/1967);

Compounds prepared by reacting hydrocarbon-substituted succinic anhydrides with boron compounds and then reacting the reaction products thus obtained with alkyleneamines (see Japanese Patent Publication No. 8014/1967);

Compounds prepared by reacting alkenylsuccinic anhydrides with hydroxylated primary amines and boron compounds (see Japanese Patent Application Laid-Open No. 52381/1976, i.e. GB Pat. No. 1513178);

Compounds prepared by reacting aromatic polyvalent carboxylic acids, alkenylsuccinic acids, and polyalkyleneamines in a specific molar ratio and then reacting the reaction products thus obtained with boron compounds (see Japanese Patent Application Laid-Open No. 130408/1976);

Condensates of aminoalcohol, boric acid, and oxyethanecarboxylic acid (see Japanese Patent Application Laid-Open No. 87705/1979, i.e. U.S. Pat. No. 4,226,734); and Compounds prepared by sequentially reacting polyalkenylsuccinic anhydrides with polyalkylene glycols, sec-alkanolamines and boron compounds.

Component (5), alkenylsuccinic acid imide and boron derivatives thereof, do not contain any metal and functions to accelerate the dispersion of insoluble materials in the lubricating oil; i.e., it acts as a dispersant. The amount of Component (5) should be from 1 to 15% by weight, preferably from 2 to 10% by weight. The beneficial effects of Component (5) cannot be sufficiently obtained if an amount less than 1% by weight is used. On the other hand, even if Component (5) is used in an amount greater than 15% by weight, there is no increase in the beneficial effects.

If necessary, various known additives can be added to the composition of the invention as described above. Examples of such additives include an antioxidant, e.g., phenols and amines; a detergent dispersant, e.g., neutral or highly basic alkaline earth metal sulfonates, phinates, carboxylates or like compounds; a viscosity-index improver, e.g., high molecular weight polymers such as polymethacrylate, polyisobutylene, polystyrene, ethylene-propylene copolymers, and styrene-isoprene copolymers; an antifoam agent, e.g., esters and silicones; a rust-preventing agent, and a pour point depressant.

The lubricating oil composition of the invention, when used as an engine oil for engines, in particular, small-sized high power four-cycle engines, fully meets the requirements for the usual engine oil and moreover, lowers the coefficient friction to about $\frac{1}{3}$ of that obtained by using conventional engine oils.

Thus the lubricating oil composition of the present invention is useful as an engine oil for four-cycle engines, particularly for small-sized high power four-cycle engines in which the mechanical friction loss is likely to increase, such as four-valve engines, and to greatly lower fuel costs.

The present invention is explained in greater detail with reference to the following Examples and Comparative Examples. The embodiments shown in the examples are for illustrative purposes only and are not extended to limit the scope of the present invention.

EXAMPLES 1 TO 21 AND COMPARATIVE EXAMPLES 1 TO 11

A mixture of 83% by weight of 150 Neutral Oil (SAE 10W, 5.1 centistokes as determined at 100° C.) and 17% by weight of 500 Neutral Oil (SAE 30, 11 centistokes as determined at 100° C.) was prepared to obtain a lubricating base oil having a kinematic viscosity of 5.8 centistokes as determined at 100° C. Then, polymethacrylate (trade name: Aclube 915; manufactured by Sanyo Kasei Kogyo Co., Ltd.) as a viscosity-index improver was added thereto to prepare a base oil consisting of 96% by weight of the lubricating base oil and 4% by weight of the polymethacrylate.

Components (2), (3), (4) and (5) as described hereinafter were added to the base oil as prepared above in a predetermined ratio to prepare a lubricating oil composition. The thus-prepared lubricating oil composition was subjected to various tests as described hereinafter. The results are shown in Tables 1 and 2.

The test methods are as follows:

(1) Coefficient of Friction

The coefficient of friction was measured by the use of a NACA (National Advisory Committee for Aeronautics) friction test machine under the following conditions:

Load: 3 kilograms,

Speed: 13.6 centimeters per second,

Ball diameter: $\frac{1}{2}$ inch,

Oil temperature: 80° C.

(2) Intake Pressure at Idle Running

A small-sized four-cycle internal combustion engine (made in Japan) was operated at a constant engine speed (1,200 revolutions per minute) without application of a load until the temperature of the oil reached equilibrium. At this time, the intake pressure in an air intake opening of the engine was measured.

Components (2), (3), (4) and (5) as used herein are as follows:

Component (2)

MoDTP: Sulfurized oxymolybdenum di(2-ethylhexyl)phosphorodithioate (trade name: Molyvan L; produced by R. T. Vanderbilt Co., Ltd.)

MoDTC: Sulfurized oxymolybdenum dialkyldithiocarbamate (trade name: Molyvan A DTC; produced by R. T. Vanderbilt Co., Ltd.)

Component (3)

Zinc dithiophosphate in which $R^5$ to $R^8$ are secondary alkyl groups containing from 3 to 6 carbon atoms (Secondary $C_{3-6}$), average carbon atoms are 5): (Lubrizol 1060 produced by Lubrizol Corporation);

Zinc dithiophosphate in which $R^5$ to $R^8$ are secondary alkyl groups containing 6 carbon atoms (Secondary $C_6$): (Lubrizol 667 produced by Lubrizol Corporation;

Zinc dithiophosphate in which $R^5$ to $R^8$ are primary alkyl groups containing from 3 to 6 carbon atoms (Primary $C_{3-6}$), average carbon atoms are 5: (Oloa 267 sold by Chevron Chemical Company (U.S.A.));

Zinc dithiophosphate in which $R^5$ to $R^8$ are primary alkyl groups containing from 4 to 8 carbon atoms (Primary $C_{4-8}$), (content (% by weight): $C_4$ 60–70%, $C_5$ 10–20%, $C_8$ 10–30%): (Amoca 198 sold by Amoco Chemicals Co. (U.S.A.)):

Zinc dithiophosphate in which $R^5$ to $R^8$ are aryl groups substituted with alkyl group containing 12 carbon atoms (Alkylaryl $C_{18}$): (Oloa 260 sold by Chevron Chemical Company (U.S.A.)).

In the tables, amount of Component (3) is a total amount of the compound used.

Component (4)

Calcium alkylbenzenesulfonate TBN 25: (M-5944 (trade name) sold by Nippon Cooper Company);

Calcium alkylbenzenesulfonate TBN 300: (HITEC E-611 (trade name) sold by Nippon Cooper Company).

Component (5)

Imide of tetraethylenepentamine and polybutenylsuccinic acid: (HITEC E-638 (trade name) produced by Edwin Cooper, Inc.). (number of carbon atoms of alkenyl group: about 70)

The symbol *A in Table 1 indicates a reaction product of polyisobutenylsuccinic acid (number of carbon atoms of alkenyl group: 71)/tetraethylenepentamine imide and boric acid.

Another Additive Component

Magnesium alkylbenzenesulfonate TBN 400: (HITEC E-654 (trade name) produced by Edwin Cooper, Inc.).

TABLE 1

| Proportion of Each Component in Composition (wt %) | | Example 1 | 2 | 3 | 4 | 5 | 6 | 7 | 8 | 9 | 10 |
|---|---|---|---|---|---|---|---|---|---|---|---|
| Component (2) | MoDTP | 0.6 | 0.6 | 0.6 | 0.6 | 0.6 | 0.3 | 4.8 | 0.6 | 0.6 | 0.6 |
| | MoDTC | — | — | — | — | — | — | — | — | — | — |
| Component (3) | Secondary $C_{3-6}$ | — | — | — | — | — | — | — | — | — | — |
| | Secondary $C_6$ | 1.0 | 1.3 | 1.0 | 1.0 | 0.7 | 1.0 | 1.0 | 0.2 | 5.0 | 1.0 |
| | Primary $C_{3-6}$ | — | — | — | — | — | — | — | — | — | — |
| | Primary $C_{4-8}$ | 0.3 | — | 0.3 | 0.3 | 0.6 | 0.3 | 0.3 | 0.1 | 1.5 | 0.3 |
| | Alkylaryl $C_{18}$ | — | — | — | — | — | — | — | — | — | — |
| Component (4) | Calcium alkylbenzenesulfonate TBN 25 | — | — | 0.8 | — | — | — | — | — | — | — |
| | Calcium alkylbenzenesulfonate TBN 300 | 0.5 | 0.5 | 0.3 | 0.5 | 0.5 | 0.5 | 0.5 | 0.5 | 0.5 | 0.2 |
| | Magnesium alkylbenzenesulfonate TBN 400 | — | — | — | 0.7 | 0.5 | — | — | — | — | — |
| Component (5) | Imide of tetraethylenepentamine and polybutenyl succinic acid | 2.7 | 2.7 | 2.7 | 2.7 | 3.0 | 3.0 | 3.0 | 3.0 | 3.0 | 3.0 |
| Component (1) | Base oil | 94.9 | 94.9 | 95.3 | 94.3 | 94.0 | 94.9 | 90.4 | 95.6 | 89.4 | 94.9 |
| Test Results | | | | | | | | | | | |
| Coefficient of Friction | | 0.037 | 0.038 | 0.040 | 0.035 | 0.038 | 0.050 | 0.042 | 0.036 | 0.040 | 0.039 |
| Idling Intake Pressure (−mmHg) | | 206 | 202 | 201 | 206 | 202 | 200 | 202 | 205 | 202 | 201 |

| Proportion of Each Component in Composition (wt %) | | Example 11 | 12 | 13 | 14 | 15 | 16 | 17 | 18 | 19 | 20 | 21 |
|---|---|---|---|---|---|---|---|---|---|---|---|---|
| Component (2) | MoDTP | 0.6 | 0.6 | 0.6 | — | — | 0.6 | 0.6 | 0.6 | — | — | — |
| | MoDTC | — | — | — | 0.6 | 1.0 | — | — | — | 0.3 | 0.6 | 1.0 |
| Component (3) | Secondary $C_{3-6}$ | — | — | — | — | — | — | 0.5 | — | 0.7 | 1.0 | — |
| | Secondary $C_6$ | 1.0 | 1.0 | 1.0 | 1.0 | 1.0 | 1.0 | 0.5 | 1.0 | 0.3 | — | 1.0 |
| | Primary $C_{3-6}$ | — | — | — | — | — | — | — | — | 0.3 | 0.3 | — |
| | Primary $C_{4-8}$ | 0.3 | 0.3 | 0.3 | 0.3 | 0.3 | — | — | 0.3 | — | — | — |
| | Alkylaryl $C_{18}$ | — | — | — | — | — | 0.3 | 0.6 | — | — | — | 0.3 |
| Component (4) | Calcium alkylbenzenesulfonate TBN 25 | — | — | — | — | — | — | — | — | — | — | — |
| | Calcium alkylbenzenesulfonate TBN 300 | 19 | 0.5 | 0.5 | 0.5 | 1.0 | 0.5 | 0.5 | 0.5 | 0.5 | 0.5 | 0.5 |
| | Magnesium alkylbenzenesulfonate TBN 400 | — | — | — | — | — | — | — | — | — | — | — |
| Component (5) | Imide of tetraethylenepentamine and polybutenyl succinic acid | 3.0 | 2.2 | 14 | 3.0 | 5.0 | 3.0 | 3.0 | *A 1.7 | *A 2.7 | *A 2.7 | *A 2.7 |
| Component (1) | Base oil | 76.1 | 95.4 | 83.6 | 94.6 | 91.7 | 94.6 | 94.3 | 95.9 | 95.2 | 94.9 | 94.5 |
| Test Results | | | | | | | | | | | | |
| Coefficient of Friction | | 0.049 | 0.038 | 0.048 | 0.050 | 0.047 | 0.039 | 0.038 | 0.041 | 0.049 | 0.041 | 0.038 |
| Idling Intake Pressure (−mmHg) | | 200 | 205 | 200 | 200 | 200 | 202 | 201 | 201 | 200 | 202 | 203 |

TABLE 2

| Proportion of Each Component in Composition (wt %) | | Comparative Example 1 | 2 | 3 | 4 | 5 | 6 | 7 | 8 | 9 | 10 | 11 |
|---|---|---|---|---|---|---|---|---|---|---|---|---|
| Component (2) | MoDTP | 0 | 0.1 | 0.6 | 8 | 0.6 | 0.6 | 0.6 | 0.6 | 0.6 | 0.6 | 0.6 |
| Component (3) | Secondary $C_6$ | 1.0 | 1.0 | — | 1.0 | 1.0 | 5.0 | 1.0 | 1.0 | 1.0 | 1.0 | 0.6 |
| | Primary $C_{3-6}$ | — | — | 1.3 | — | — | — | — | — | — | — | — |
| | Primary $C_{4-8}$ | 0.3 | 0.3 | — | 0.3 | 0.3 | 4.0 | 0.3 | 0.3 | 0.3 | 0.3 | 0.7 |
| Component (4) | Calcium alkylbenzenesulfonate TBN 25 | 1.7 | 1.7 | 1.7 | — | — | — | — | — | — | — | 0.9 |
| | Calcium alkylbenzenesulfonate TBN 300 | — | — | — | 0.5 | — | 0.5 | — | 22 | 0.5 | 0.5 | 0.2 |
| | Magnesium alkylbenzenesulfonate TBN 400 | 0.7 | 0.7 | 0.7 | — | 0.7 | — | — | — | — | — | 0.7 |
| Component (5) | Imide of tetraethylenepentamine and polybutenyl succinic acid | 1.7 | 1.7 | 1.7 | 2.7 | 2.7 | 2.7 | 2.7 | 2.7 | 0.5 | 17 | 2.7 |
| Component (1) | Base oil | 94.6 | 94.5 | 94.0 | 87.5 | 94.7 | 90.2 | 95.4 | 73.4 | 97.1 | 80.6 | 93.6 |
| Test Results | | | | | | | | | | | | |
| Coefficient of Friction | | 0.116 | 0.108 | 0.101 | 0.052 | 0.072 | 0.080 | 0.055 | 0.092 | 0.053 | 0.097 | 0.089 |
| Idling Intake Pressure (−mmHg) | | 160 | 160 | 166 | 190 | 171 | 190 | 191 | 172 | 192 | 170 | 170 |

What is claimed is:

1. A lubricating oil composition consisting essentially of:

(1) 98.6 to 53% by weight of a base oil having a kinematic viscosity of 3 to 20 centistokes as determined at 100° C.;

(2) 0.2 to 5% by weight of at least one compound selected from a sulfurized oxymetal organophosphorodithioate of the formula (I):

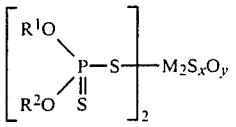

(I)

wherein M is molybdenum or tungsten, $R^1$ and $R^2$ may be the same or different, each of $R^1$ and $R^2$ contains from 1 to 30 carbon atoms and are selected from the group consisting of an alkyl group, a cycloalkyl group, an aryl group, and a alkylaryl group; and x and y are positive real numbers satisfying the equation: x and y=4; and a sulfurized oxymetal dithiocarbamate of the formula (II):

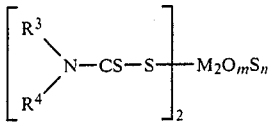

(II)

wherein M is molybdenum or tungsten, $R^3$ and $R^4$ may be the same or different and each of $R^3$ and $R^4$ contains 1 to 30 carbon atoms and is selected from the group consisting of an alkyl group, a cycloalkyl group, an aryl group, and an alkylaryl group; and m and n are positive real numbers satisfying the equation: m+n=4;

(3) 0.1 to 7% by weight of at least one zinc dithiophosphate of the formula (III):

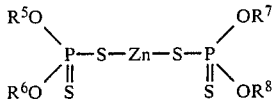

(III)

wherein $R^5$ to $R^8$ may be the same or different and are each selected from the group consisting of a primary alkyl group containing 1 to 20 carbon atoms, a secondary alkyl group containing 3 to 20 carbon atoms, an aryl group and an aryl group substituted by an alkyl group, said alkyl substituent containing 1 to 20 carbon atoms, provided that the proportion of the secondary alkyl groups containing 3 to 20 carbon atoms based on the total amount of $R^5$ to $R^8$ in the zinc dithiophosphate compound is at least 50% by weight:

(4) 0.1 to 20% by weight of a calcium alkylbenzenesulfonate and/or calcium petroleumsulfonate, wherein the alkyl group contains 1 to 50 carbon atoms; and (5) 1 to 15% by weight of at least one compound selected from the group consisting of alkenylsuccinic acid imides and boron derivatives thereof, wherein the alkenyl group contains from 30 to 300 carbon atoms.

2. The composition of claim 1 wherein the kinematic viscosity of said oil is in the range of 6 to 12 centistokes as measured at 100° C.

3. The composition of claim 2 wherein said oil is present in an amount of between 70 and 97% by weight.

4. The composition of claim 1 wherein said oil is at least one oil selected from a mineral oil and a synthetic oil.

5. The composition of claim 4 wherein the synthetic oil is selected from the group consisting of polyolefins, polyglycol esters, polyol esters, phosphates, silicone oil, alkyldiphenyls, and dibasic acid esters.

6. The composition of claim 1 wherein Component (2) is present in amount between 0.3 and 3% by weight.

7. The composition of claim 1 wherein the sulfurized oxymetal organophosphorodithioate compound is selected from the group consisting of sulfurized oxymolybdenum diisopropylphosphorodithioate, sulfurized oxytungsten diisopropylphosphorodithioate, sulfurized oxymolybdenum diisobutylphosphorodithioate, sulfurized oxymolybdenum di(2-ethylhexyl)phosphorodithioate, sulfurized oxymolybdenum diphenylphosphorodithioate, sulfurized oxymolybdenum di(p-tert-butylphenyl)phosphorodithioate, sulfurized oxytungsten(di(p-tert-butylphenyl)-phosphorodithioate, sulfurized oxymolybdenum di(nonylphenyl)phosphorodithioate, and sulfurized oxymolybdenum dicyclohexyl phosphorodithioate.

8. The composition of claim 1 wherein the sulfurized oxymetal dithiocarbamate compound is selected from the group consisting of sulfurized oxymolybdenum dibutyldithiocarbamate, sulfurized oxytungsten dibutyldithiocarbamate, sulfurized oxymolbdenum diethyldithiocarbamate, sulfurized oxytungsten di(2-ethylhexyl)-dithiocarbamate, sulfurized oxymolybdenum diamyldithiocarbamate, sulfurized oxymolybdenum dilauryldithiocarbamate, sulfurized oxymolybdenum di(oleyllinoleyl)dithiocarbamate, sulfurized oxymolybdenum di(p-tert-butylphenyl)dithiocarbamate, and sulfurized oxymolybdenum dicyclohexyldithiocarbamate.

9. The composition of claim 1 wherein the at least one zinc dithiophosphate compound is present in an amount between 0.3 and 3.0% by weight.

10. The composition of claim 1 wherein in said at least one zinc dithiophosphate the proportion of secondary alkyl groups to the total amount of $R^5$ to $R^8$ is from 60 to 100% by weight.

11. The composition of claim 1 wherein in said at least one zinc dithiophosphate the secondary alkyl group contains 3 to 6 carbon atoms.

12. The composition of claim 11 wherein in said at least one zinc diothiophosphate the primary alkyl group contains 3 to 8 carbon atoms.

13. The composition of claim 1 wherein the calcium alkylbenzenesulfonate compound is present in an amount between 0.2 and 10% by weight.

14. The composition of claim 1 wherein the calcium alkylbenzenesulfonate compound is selected from the group consisting of calcium dodecylbenzenesulfonate, calcium didodecylbenzenesulfonate, calcium hexadecylbenzenesulfonate, calcium eicosylbenzenesulfonate, calcium dieicosylbenzenesulfonate, and calcium tetracosylbenzenesulfonate.

15. The composition of claim 1 wherein the alkenylsuccinic acid imide compound is present in an amount between 2 and 10% by weight.

16. A lubricating oil composition consisting essentially of:

(1) 98.6 to 53% by weight of a base oil having a kinematic viscosity of 6 to 12 centistokes as determined at 100° C.;

(2) 0.2 to 5% by weight of at least one compound selected from a sulfurized oxymetal organophosphorodithioate selected from the group consisting of sulfurized oxymolybdenum diisopropylphosphorodithioate, sulfurized oxytungsten diisopropylphosphorodithioate, sulfurized oxymolybdenum diisobutylphosphorodithioate, sulfurized oxymolybdenum di(2-ethylhexyl)phosphorodithioate, sulfurized oxymolybdenum diphenylphosphorodithioate, sulfurized oxymolybdenum di(p-tert-butylphenyl)phosphorodithioate, sulfurized oxytungsten di(p-tert-butylphenyl)phosphorodithioate, sulfurized oxymolybdenum di(nonylphenyl)-phosphorodithioate, and sulfurized oxymolybdenum dicyclohexylphosphorodithioate;

(3) 0.3 to 3.0% by weight of at least one zinc dithiophosphate represented by the general formula (III):

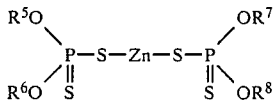

(III)

wherein $R^5$ to $R^8$ may be the same or different and are each selected from the group consisting of a primary alkyl group containing 1 to 20 carbon atoms, a secondary alkyl group containing 3 to 20 carbon atoms, and an aryl group substituted by an alkyl group, said alkyl substituent containing 1 to 20 carbon atoms, provided that the proportion of the secondary alkyl group containing 3 to 20 carbon atoms based on the total amount of $R^5$ to $R^8$ in the zinc dithiophosphate compound is at least 50% by weight;

(4) 0.2 to 10% by weight of a calcium alkylbenzenesulfonate compound selected from the group consisting of calcium dodecylbenzenesulfonate, calcium didodecylbenzenesulfonate, calcium hexadecylbenzenesulfonate, calcium eicosybenzenesulfonate, calcium dieicosylbenzenesulfonate, and calcium tetracosylbenzenesulfonate, and/or calcium petroleumsulfonate;

(5) 1 to 15% by weight of at least one compound selected from the group consisting of alkenylsuccinic acid imide and boron derivatives thereof, wherein the alkenyl group contains from 30 to 300 carbon atoms.

17. The composition of claim 16 wherein said oil is present in an amount of between 70 and 97% by weight.

18. The composition of claim 16 wherein the synthetic oil is selected from the group consisting of polyolefins, polyglycol esters, polyol esters, phosphates, silicone oil, alkyldiphenyls, and dibasic acid esters.

19. The composition of claim 17 wherein Component (2) is present in amount wherein 0.3 and 3% by weight.

20. The composition of claim 16 wherein in said at least one zinc dithiophosphate the proportion of secondary alkyl groups to the total amount of $R^5$ to $R^8$ is from 60 to 100% by weight.

21. The composition of claim 20 wherein the alkenylsuccinic acid amide compound is present in an amount between 2 and 10% by weight.

* * * * *